US008092252B2

(12) United States Patent
Peng

(10) Patent No.: US 8,092,252 B2
(45) Date of Patent: Jan. 10, 2012

(54) ELECTRICAL CONNECTOR

(75) Inventor: Yung-Chi Peng, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 79 days.

(21) Appl. No.: 12/790,910

(22) Filed: May 31, 2010

(65) Prior Publication Data

US 2011/0294345 A1 Dec. 1, 2011

(51) Int. Cl.
*H01R 13/73* (2006.01)

(52) U.S. Cl. ..... 439/559; 439/352; 439/607.25

(58) Field of Classification Search ..... 439/607.25, 439/352, 559

See application file for complete search history.

(56) References Cited

U.S. PATENT DOCUMENTS

| | | | | |
|---|---|---|---|---|
| 4,641,906 | A * | 2/1987 | Olsson | 439/465 |
| 5,352,995 | A * | 10/1994 | Mouissie | 333/181 |
| 5,637,014 | A * | 6/1997 | Sukegawa et al. | 439/607.4 |
| 5,718,605 | A * | 2/1998 | Morikawa et al. | 439/607.27 |
| 6,338,651 | B1 * | 1/2002 | Svette et al. | 439/559 |
| 6,422,899 | B1 * | 7/2002 | Miyazaki | 439/559 |
| 6,629,859 | B2 * | 10/2003 | Hoshino et al. | 439/607.25 |
| 7,645,170 | B2 * | 1/2010 | Long et al. | 439/668 |
| 7,887,370 | B2 * | 2/2011 | Chen et al. | 439/607.35 |

* cited by examiner

*Primary Examiner* — Truc Nguyen

(57) ABSTRACT

An electrical connector includes an insulating body defining a receiving chamber of which a top inside is further concaved upward to form a buckling cavity, an inner cover and an outer shell mounted outside the insulating body. A top wall of the buckling cavity is provided with a window vertically penetrating therethrough to communicate with the buckling cavity. The inner cover has a covering board buckled in the buckling cavity and facing to the window. The outer shell has a base plate covered on the top wall. A portion of the base plate is punched downward to form a contact portion which stretches into the window to electrically contact the covering board of the inner cover so as to achieve a grounding function of the inner cover through the outer shell.

8 Claims, 5 Drawing Sheets

ELECTRICAL CONNECTOR

BACKGROUND OF THE INVENTION

1. Field of the Invention

The present invention relates to an electrical connector, and more particularly to an electrical connector having a water-proof function.

2. The Related Art

A conventional electrical connector includes an insulating body, a plurality of terminals disposed in the insulating body, and a shell mounted around the insulating body. The shell is made of a metal sheet and shows a box shape to define a receiving space therein. The insulating body has a base portion mated with a rear of the receiving space of the shell, and a tongue portion extended forward from the base portion into a front of the receiving space. The shell has a bottom board of which two opposite side edges are respectively provided with a soldering portion for being soldered to a printed circuit board. The bottom board further defines a buckling hole penetrating therethrough for locking a corresponding buckling portion of a mating connector therein. However, the water entering the receiving space from a front end mouth of the receiving space is apt to further flow onto the printed circuit board through the buckling hole or along the soldering portion to damage the printed circuit board. Therefore, an electrical connector capable of overcoming the foregoing problems is required.

SUMMARY OF THE INVENTION

It is an object of the present invention to provide an electrical connector having a water-proof function. The electrical connector adapted for being mounted to a printed circuit board includes an insulating body, a plurality of terminals disposed in the insulating body, an inner cover and an outer shell. The insulating body defines a receiving chamber with a front end being opened freely. A middle of a rear wall of the receiving chamber protrudes forward into the receiving chamber to form a tongue. A top inside of the receiving chamber is further concaved upward to form a buckling cavity of which a top wall is provided with a window vertically penetrating therethrough to communicate with the buckling cavity. The inner cover has a covering board which is buckled in the buckling cavity of the insulating body and faces to the window. The outer shell is mounted outside the insulating body. The outer shell has a base plate covered on the top wall and at least one soldering tail soldered to the printed circuit board. A portion of the base plate is punched downward to form a contact portion which stretches into the window to electrically contact the covering board of the inner cover so as to achieve a grounding function of the inner cover through the outer shell and the printed circuit board and further prevent the water which enters the receiving chamber from a front end mouth of the receiving chamber from flowing onto the printed circuit board.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
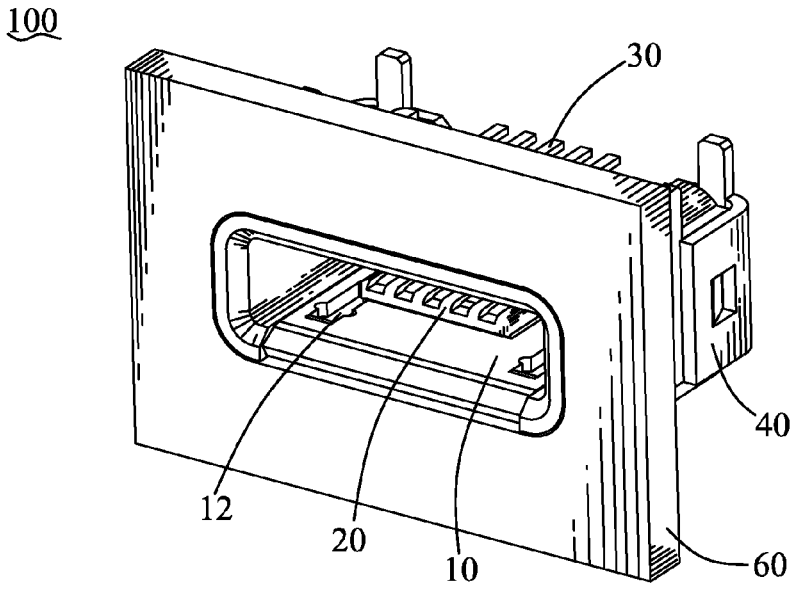
FIG. 1 is an assembled perspective view of an electrical connector in accordance with the present invention.
Figure 2:
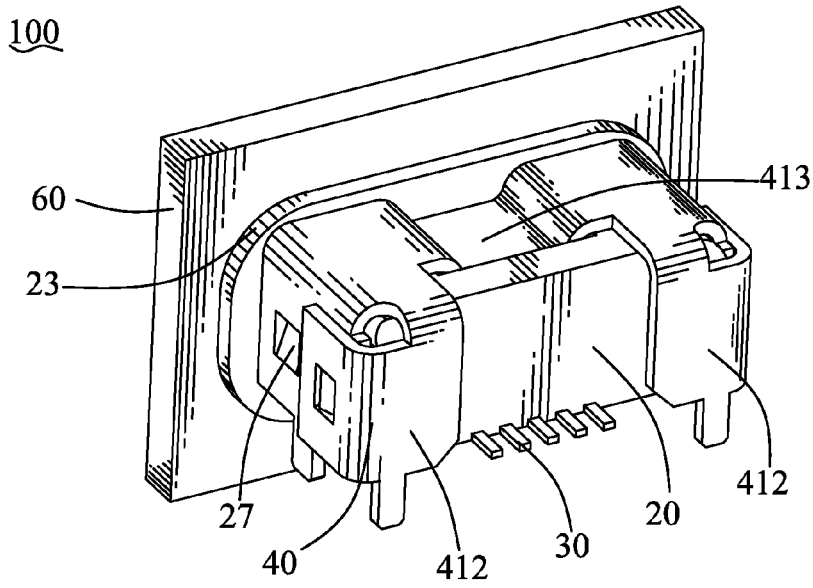
FIG. 2 is an assembled perspective view of the electrical connector of FIG. 1 viewed from another angle.
Figure 3:
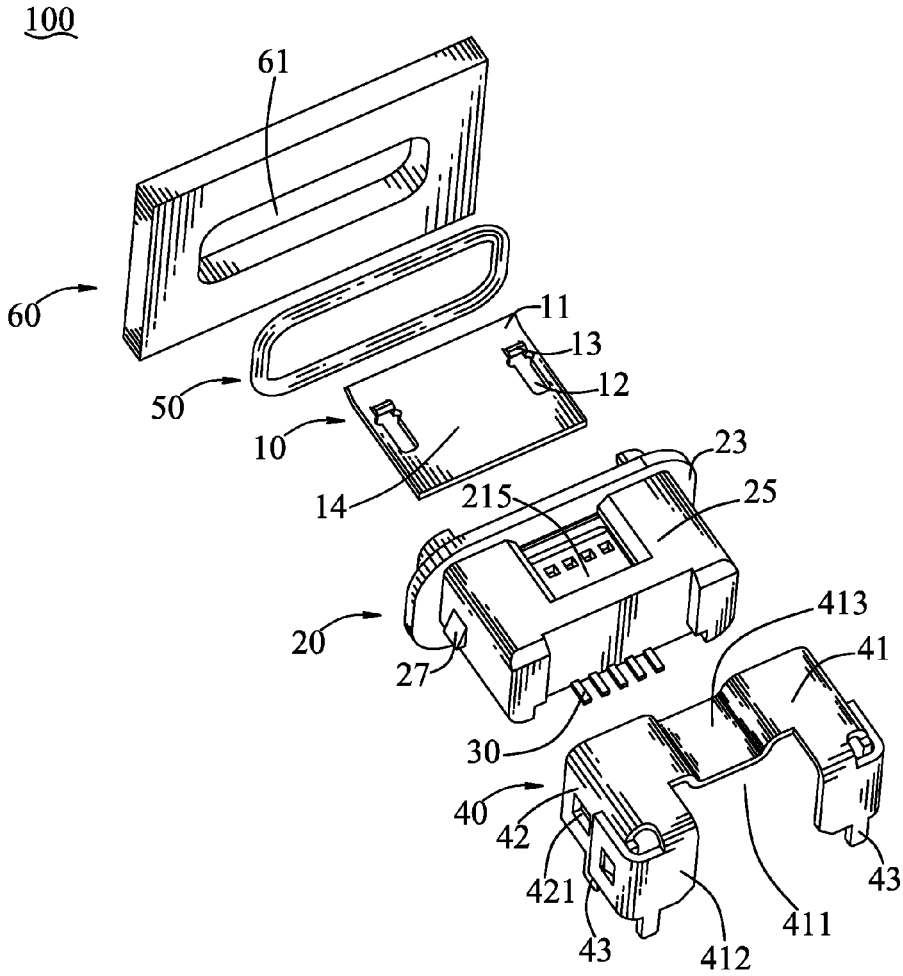
FIG. 3 is an exploded perspective view of the electrical connector of FIG. 1.

Referring to FIG. 1 and FIG. 3, an electrical connector 100 according to the present invention includes an inner cover 10, an insulating body 20, a plurality of terminals 30 integrated in the insulating body 20, an outer shell 40, an elastic band 50 and a restraining member 60 mounted to the insulating body 20 respectively.

Figure 4:
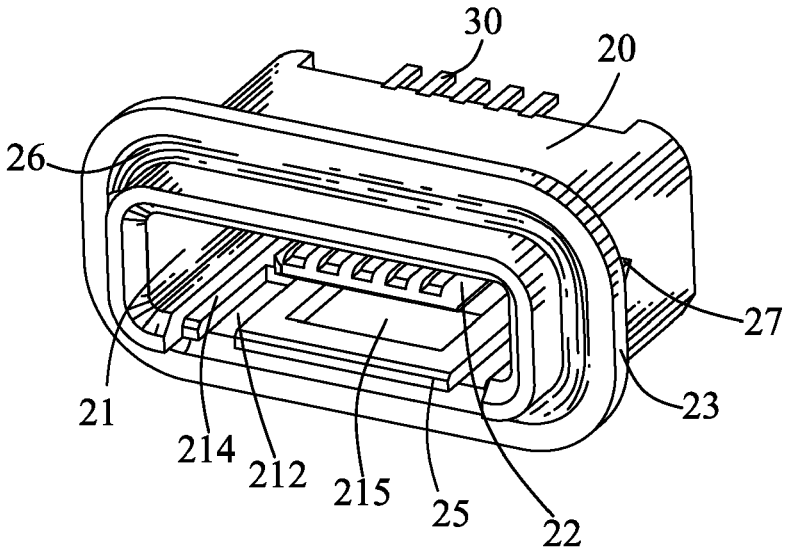
FIG. 4 is a perspective view of an insulating body with a plurality of terminals of the electrical connector of FIG. 1.
Figure 5:
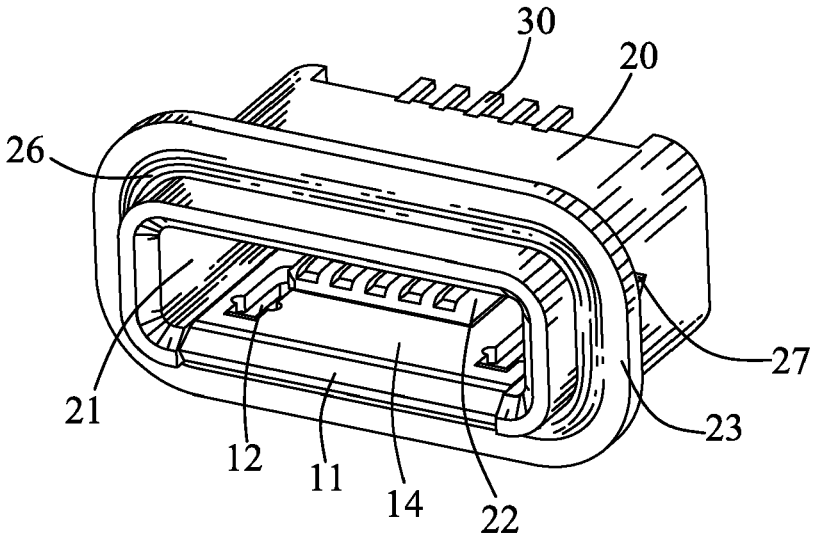
FIG. 5 is an assembled perspective view showing that an inner cover of the electrical connector of FIG. 1 is mounted in the insulating body with the terminals of FIG. 4.
Figure 6:
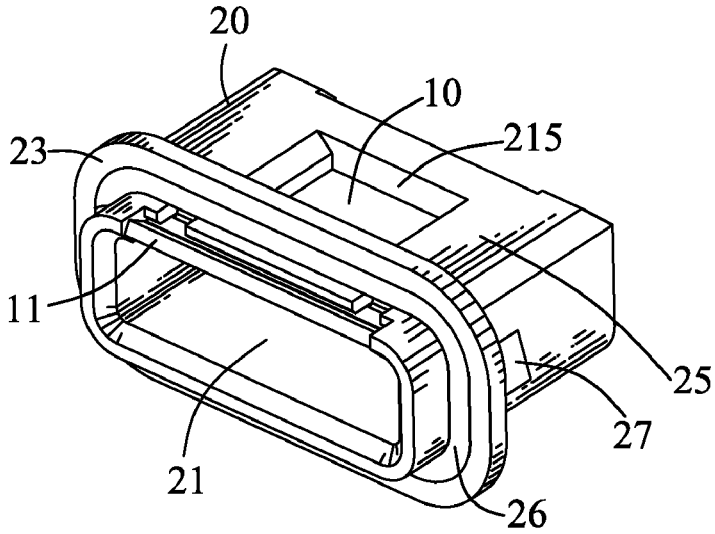
FIG. 6 is an assembled perspective view of the insulating body, the terminals and the inner cover of FIG. 5 viewed from another angle.
Figure 7:
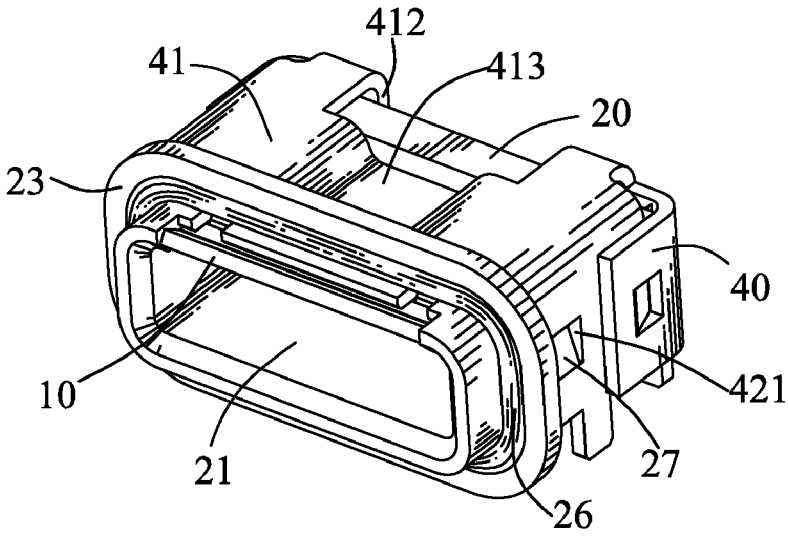
FIG. 7 is an assembled perspective view of the electrical connector of FIG. 1 without an elastic band and a restraining member.
Figure 8:
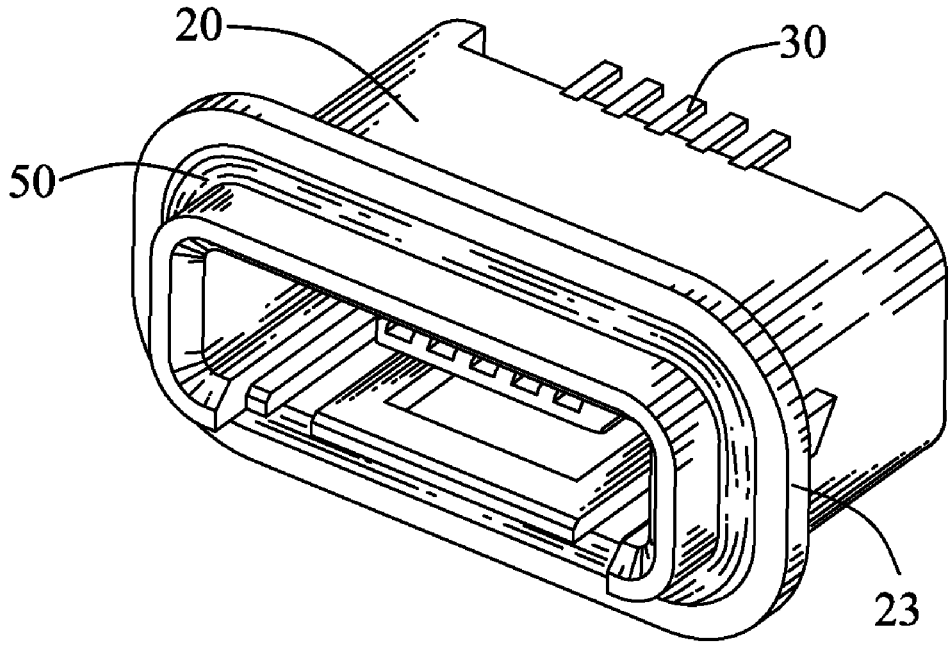
FIG. 8 is an assembled perspective view showing that the elastic band of the electrical connector of FIG. 1 is sleeved to the insulating body with the terminals of FIG. 4.

Referring to FIG. 3 and FIG. 4, the insulating body 20 is of rectangular shape. A middle of the insulating body 20 defines a substantially rectangular receiving chamber 21 passing through a front surface thereof. A middle of a rear wall of the receiving chamber 21 protrudes forward into the receiving chamber 21 to form a tongue 22 apart from insides of the receiving chamber 21. A top inside of the receiving chamber 21 is further concaved upward to form a rectangular buckling cavity 214 of which a top wall 25 is provided with a pair of locking troughs 212 communicating with the buckling cavity 214 at two opposite sides thereof, and a window 215 penetrating through a middle thereof. A preventing portion 23 of substantially rectangular-ring shape transversely encircles a front end of the insulating body 20 and apart from a front edge of the insulating body 20. A rear of the preventing portion 23 is connected with the insulating body 20, and accordingly, a buckling channel 26 is formed between a front of the preventing portion 23 and the insulating body 20. Two opposite outsides of the insulating body 20 oppositely protrude to form a buckling hook 27 respectively.

Referring to FIG. 3 again, the inner cover 10 has a rectangular covering board 14. A front edge of the covering board 14 extends upward and is inclined forward to form a guiding eave 11. The covering board 14 further defines two openings 12 at two sides thereof with a distance therebetween as well as the one between the locking troughs 212 of the insulating body 20. A front edge of the opening 12 protrudes upward to form a locking portion 13. The outer shell 40 has a rectangular base plate 41 of which a middle of a rear edge is concaved inward to form a gap 411, two opposite ends of the rear edge extend downward to form a pair of resisting plates 412. A middle of the base plate 41 is punched downward to form a contact portion 413. Two opposite side edges of the base plate 41 extend downward to form two side plates 42 facing each other. Each of the side plates 42 defines a buckling hole 421. Bottom edges of the side plates 42 and the resisting plates 412 are respectively provided with a soldering tail 43 extending downward.

Referring to FIGS. 1-8, in assembly, the covering board 14 of the inner cover 10 is buckled in the buckling cavity 214 of the insulating body 20 with a middle thereof facing to the window 215. The locking portions 13 are locked in the corresponding locking troughs 212. The guiding eave 11 wraps up a front edge of the top wall 25 for guiding a mating connector to be inserted into the receiving chamber 21. Then the outer shell 40 is attached outside the insulating body 20, and the base plate 41 is covered on the top wall 25. The contact portion 413 stretches into the window 215 to electrically contact the covering board 14 so as to achieve a grounding function of the inner cover 10 through the outer shell 40. Front edges of the base and side plates 41, 42 abut against the preventing portion 23, the buckling hooks 27 are buckled in the corresponding buckling holes 421, and the resisting plates 412 tightly resist against two opposite ends of a rear surface of the insulating body 20, so that ensure the outer shell 40 mounted to the insulating body 20 firmly. The soldering tails 43 are inserted into and soldered to a printed circuit board (not shown) for achieving a grounding function of the outer shell 40 through the printed circuit board and further fixing the electrical connector 100 on the printed circuit board. The elastic band 50 is of rectangular-ring shape and sleeved in the buckling channel 26 of the insulating body 20. The restraining member 60 is of rectangular board shape and defines a buckling opening 61 for buckling the front end of the insulating body 20 therein. The restraining member 60 tightly abuts against the elastic band 50 and the preventing portion 23.

As described above, the electrical connector 100 of the present invention can effectively prevent the water, which enters the receiving chamber 21 of the insulating body 20 from a front end mouth of the receiving chamber 21, from flowing onto the printed circuit board along the openings 12 of the inner cover 10 by means of the covering board 14 being tightly located in the buckling cavity 214 of the insulating body 20. Moreover, the contact portion 413 stretches into the window 215 of the insulating body 20 to electrically contact the covering board 14 so as to achieve the grounding function of the inner cover 10 through the outer shell 40, so that further prevent the water from flowing onto the printed circuit board along the soldering portion of the prior art.

What is claimed is:

1. An electrical connector adapted for being mounted to a printed circuit board, comprising:

an insulating body defining a receiving chamber with a front end being opened freely, a middle of a rear wall of the receiving chamber protruding forward into the receiving chamber to form a tongue, a top inside of the receiving chamber being further concaved upward to form a buckling cavity of which a top wall is provided with a window penetrating therethrough to communicate with the buckling cavity;

a plurality of terminals disposed in the insulating body;

an inner cover having a covering board which is positioned in the buckling cavity of the insulating body and faces to the window; and an outer shell mounted outside the insulating body, the outer shell having a base plate covered on the top wall and at least one soldering tail soldered to the printed circuit board, a portion of the base plate being punched downward to form a contact portion which stretches into the window to electrically contact the covering board of the inner cover so as to achieve a grounding function of the inner cover through the outer shell and the printed circuit board and further prevent the water which enters the receiving chamber from a front end mouth of the receiving chamber from flowing onto the printed circuit board.

2. The electrical connector as claimed in claim 1, wherein an inside of the top wall adjacent to the buckling cavity defines at least one locking trough communicating with the buckling cavity, the covering board of the inner cover defines at least one opening of which a front edge protrudes upward to form a locking portion locked in the locking through.

3. The electrical connector as claimed in claim 2, wherein a front edge of the covering board extends upward and is inclined forward to form a guiding eave wrapping up a front edge of the top wall.

4. The electrical connector as claimed in claim 1, wherein two opposite side edges of the base plate of the outer shell extend downward to form two side plates against two opposite outsides of the insulating body, each of the side plates defines a buckling hole, the two opposite outsides of the insulating body oppositely protrude to form a buckling hook respectively buckled in the corresponding buckling hole, the soldering tail is formed by extending downward from a portion of a bottom edge of each side plate.

5. The electrical connector as claimed in claim 4, wherein two opposite ends of a rear edge of the base plate extend downward to form a pair of resisting plates against two ends of a rear surface of the insulating body, the soldering tail is further formed by extending downward from a portion of a bottom edge of each resisting plate.

6. The electrical connector as claimed in claim 1, wherein a ring-shaped preventing portion transversely encircles a front end of the insulating body and apart from a front edge of the insulating body, a front edge of the base plate of the outer shell abuts against the preventing portion.

7. The electrical connector as claimed in claim 6, wherein a rear of the preventing portion is connected with the insulating body, and a buckling channel is formed between a front of the preventing portion and the insulating body, the electrical connector further comprises an elastic band sleeved around the front end of the insulating body and buckled in the buckling channel.

8. The electrical connector as claimed in claim 7, further comprising a restraining member which defines a buckling opening for buckling the front end of the insulating body therein so as to abut against the elastic band and the preventing portion.

* * * * *